US005757112A

United States Patent [19]

Van Dulmen

[11] Patent Number: 5,757,112

[45] Date of Patent: May 26, 1998

[54] IRRADIATION DEVICE

[75] Inventor: Hendrikus A. M. Van Dulmen, Eindhoven, Netherlands

[73] Assignee: U.S. Philips Corporation, New York, N.Y.

[21] Appl. No.: 815,243

[22] Filed: Mar. 12, 1997

[30] Foreign Application Priority Data

Mar. 22, 1996 [EP] European Pat. Off. ..... 96200789

[51] Int. Cl.[6] ..... F21V 21/00

[52] U.S. Cl. ..... 313/113; 313/318.02; 362/306; 362/217

[58] Field of Search ..... 313/113, 318.02; 362/217, 226, 260, 263, 306

[56] References Cited

U.S. PATENT DOCUMENTS

| | | | |
|---|---|---|---|
| 3,944,808 | 3/1976 | Vause | 362/296 |
| 4,514,793 | 4/1985 | Anderson | 362/306 |
| 4,674,016 | 6/1987 | Gallagher | 362/217 |
| 5,001,388 | 3/1991 | Janssen et al. | 313/318.02 |

FOREIGN PATENT DOCUMENTS

| | | |
|---|---|---|
| 0560420 | 9/1993 | European Pat. Off. . |
| 0643021 | 3/1995 | European Pat. Off. . |

*Primary Examiner*—Nimeshkumar Patel

[57] ABSTRACT

The irradiation device has a concave reflector (1) and a pair of spaced holders (10) for mechanically holding an elongate electric radiation source (30). The holders (10) have a rigid base (11) and a rigid first wall (12) rigidly connected thereto and a second wall (12). The second wall (12) has a resilient element (14) having an end portion (15) which is directed to the base (11) as well as to the first wall (12) at an acute angle. The element (14) is able to urge a cap (31) of a double-ended capped radiation source (30) towards the base (11) and the first wall (12) so as to hold that source (30) in an aligned position with respect to the reflector (1).

14 Claims, 3 Drawing Sheets

IRRADIATION DEVICE

BACKGROUND OF THE INVENTION

The invention relates to an irradiation device comprising:

a concave reflector;

a pair of mutually separated holders for mechanically retaining an elongate electric radiation source at two ends, which holders lie in one another's extended direction and are connected to the reflector, and which holders each have a base and transverse thereto a first and a second wall in mutual opposition.

Such an irradiation device is known from U.S. Pat. No. 3,944,808.

In the known device, the holders are folded from sheet metal, and the second wall is deformed towards the interior so as to form a fold which is transverse to the base and which can grip into a transverse groove in a seal of a radiation source to be accommodated for preventing a longitudinal shifting of this radiation source. The first wall can be folded around the radiation source and welded to the second wall.

It is a disadvantage of the known device that the welding of the holders renders a replacement of the accommodated radiation source impossible.

Another disadvantage is that the distance from an accommodated radiation source to the base of the holder, and thus to the reflector, is not unequivocally defined. A further disadvantage is that the location of the radiation source in directions transverse to the holder walls, i.e. transverse to its longitudinal direction and parallel to the base, is undefined. In the case of an elongate radiation source, however, the position in exactly these directions is often more important for the beam formed by the reflector from the generated radiation than is the position of the radiation source in its longitudinal direction, which is the only position defined here by the fold in the second wall of each holder and the groove cooperating therewith. It is also a disadvantage that the retention of the radiation source is not assured if the bases of the holders lie above the radiation source, unless the holders are closed by welding.

An electric radiation source is known from U.S. Pat. No. 5,001,388 where the radiation source may be an incandescent body in a gas comprising halogen present in an elongate quartz-glass vessel with pinch seals at mutually opposed ends thereof. Respective ceramic lamp caps, from each of which a cable connected to the incandescent body issues, are fixed on the pinch seals. The ceramic caps have a smooth, non-profiled surface. The radiation source may be used, for example, as an infrared radiator.

An IR-radiating lamp is known from EP-A-0 560 420 whose quartz-glass lamp vessel is colored owing to the presence of a coloring agent created in situ through heating of a precursor. An IR-radiating lamp is also known from EP-A-0 643 021, and a similar lamp is described in the patent application of earlier date EP 95 20 28 12.4 (PHN 15.511). The quartz glass of the lamp vessel therein is doped with samarium.

SUMMARY OF THE INVENTION

It is an object of the invention to provide an irradiation device of the kind described in the opening paragraph which can readily accommodate a radiation source, while the holders mechanically retain an accommodated radiation source in a reliable manner and in a predetermined position.

According to the invention, this object is achieved in that the second wall has a resilient element with an end portion which lies at a distance from the base and which is directed to the base and to the first wall at an acute angle, and the base and the first wall are comparatively rigid and are comparatively rigidly interconnected.

Owing to the comparative rigidity of the base and first wall with respect to the resilient element and their comparatively rigid interconnection, the base and the first wall can serve as references for the position of a radiation source to be accommodated in two mutually transverse directions. The end portion of the resilient element will press the radiation source against said references.

The device has the advantage that the holders may have a small height. It is in fact the transverse dimension of the radiation source and the reflector, especially the focal point or focal line of the latter, which determines the location where the radiation source is to be held relative to the reflector. The height of the holders may be adapted to this in any particular device.

It is favorable when an elevation is present on the base between the walls. The radiation source may then abut against this elevation. This embodiment has the advantage that it can be ensured thereby that screws or other means by which the holders are fixed cannot hamper a contact between the radiation source and the base. The elevation may also serve to set the desired distance from the radiation source to the reflector through the choice of the dimension of this elevation. It is favorable for the simplicity of the holder when the elevation is a tag which was cut from the base and bent out.

The resilient element of the second wall may be integral with the second wall. The element may here have a weaker spring characteristic than the first wall and the base in that it has a smaller width.

In a favorable embodiment, however, the resilient element is a separate component. This renders it possible to choose the spring characteristic for a given application from a wide range. The resilient element, for example made from spring steel, may be fastened to the holder, for example with welds. In a favorable embodiment, the second wall has incisions which extend transversely to the base and which define a tongue which is bent from the second wall and extends substantially parallel thereto. The tongue may thus form a seat for the resilient element. It can be achieved thereby that the resilient element is fastened in a predetermined position.

In a favorable modification, the resilient element has a recess which faces towards the base and through which the tongue extends. This modification provides a further simplification for positioning the element accurately before it is fastened.

It is favorable for the ease with which a radiation source can be positioned when the resilient element and the first wall have an insertion opening which narrows towards the base. A radiation source may thus be pressed more easily into the holder.

It is favorable, furthermore, when the first wall has at least three stamped bulges in spatial distribution and facing the second wall so as to form together a discrete abutment for the radiation source.

The irradiation device may be used singly or together with a few or many similar devices, for example arranged so as to form a tunnel, for irradiating objects, for example in industrial processes, such as drying of paints or inks or curing of synthetic resins by means of IR or UV radiation. The assured positioning and retention possibilities of the holders in fact render it possible to use the device in a reliable manner also with the bases of the holders perpendicularly above the radiation sources. The radiation sources may then still be quickly and easily replaced with new ones, simply in that they are pulled from the holders.

It is favorable for the above application when the reflector is concave in the direction transverse to the pair of holders and plane in the direction of said pair.

The electric radiation source may here have, for example, a quartz-glass vessel which is closed in a gastight manner and which has seals accommodated, for example, in block-shaped, for example ceramic caps, for example lamp caps. Electric conductors, for example metal strips or insulated cables, may issue from said caps to the exterior so as to be connected to contacts. The radiation source may be a pair of electrodes in an ionizable gas, or an incandescent body, for example of tungsten, for example in a gas which comprises a halogen, for example hydrogen bromide, so as to form the electric element which generates radiation.

When a flat, ceramic cap of a double-capped electric radiation source, for example with a quartz-glass vessel which is closed in a gastight manner, is accommodated in each holder of the irradiation device, the resilient element will press against a common edge of two surfaces of each cap, and the spring will position the cap against the first wall and against the base. At the same time, the spring blocks the way back to the exterior for the cap and keeps the cap reliably in position.

BRIEF DESCRIPTION OF THE DRAWINGS

An embodiment of the irradiation device according to the invention is shown in the drawing, in which.

DETAILED DESCRIPTION OF THE PREFERRED EMBODIMENTS

Figure 1:
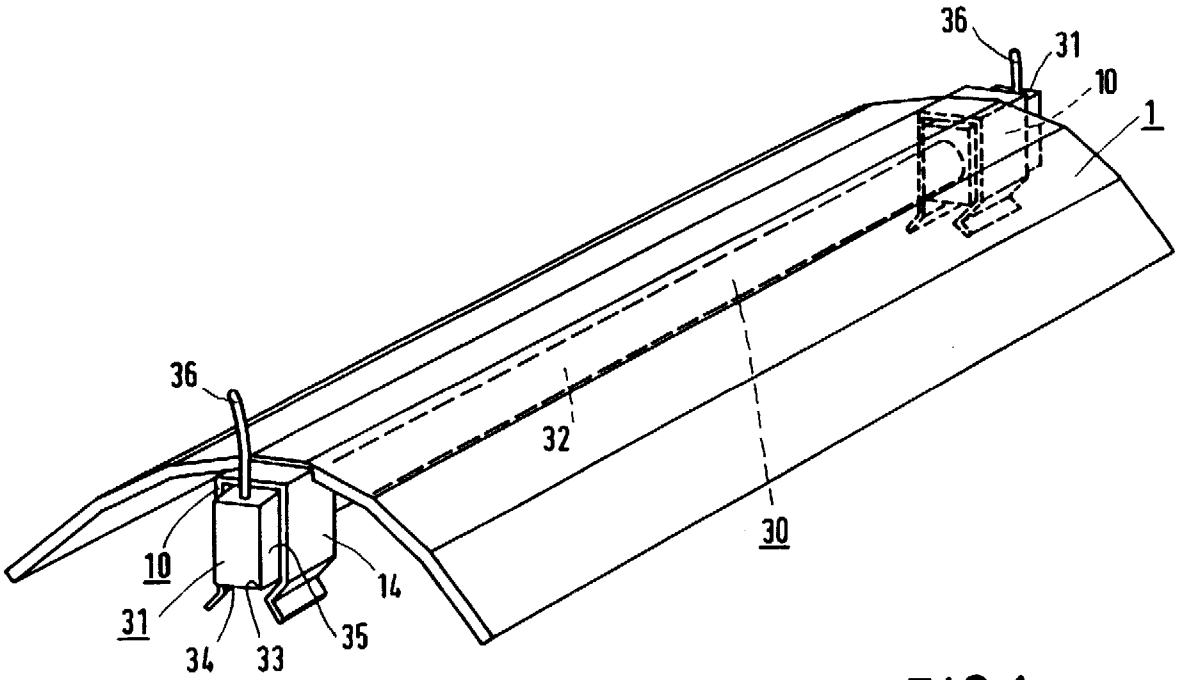
FIG. 1 shows an embodiment provided with a radiation source in perspective view.

The irradiation device of FIG. 1 has a concave reflector 1 and a pair of mutually separated holders 10 which lie in one another's extended direction and are connected to the reflector for holding an elongate electric radiation source 30 at its two ends 31. The radiation source has a quartz-glass vessel 32 which is closed in a gastight manner, which is filled with a gas comprising a halogen, and in which a tungsten incandescent body is present for generating IR radiation. The holders 10 retain the radiation source mechanically only. The radiation source is electrically supplied through cables 36 which are connected to a supply source elsewhere. The holders 10, see also FIGS. 2 and 3, each have a base 11 and transverse thereto a first 12 and a second wall 13 in mutual opposition.

Figure 2:
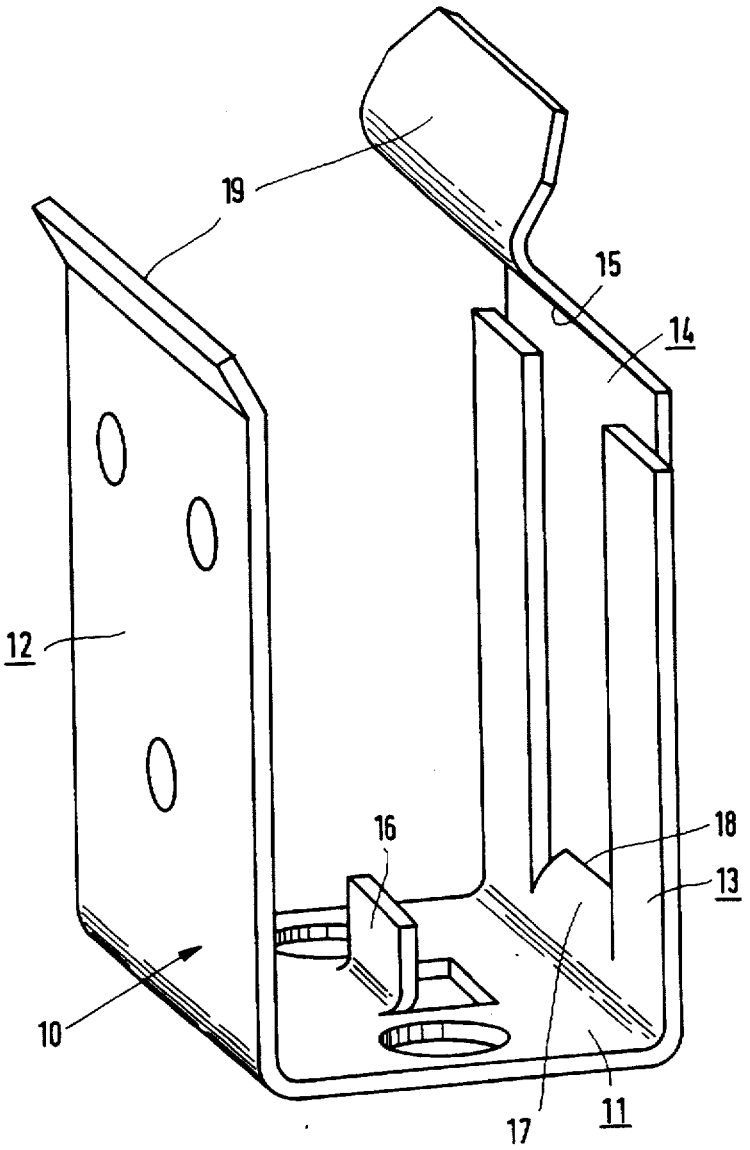
FIGS. 2 and 3 show the holder from FIG. 1 in perspective view.
Figure 3:
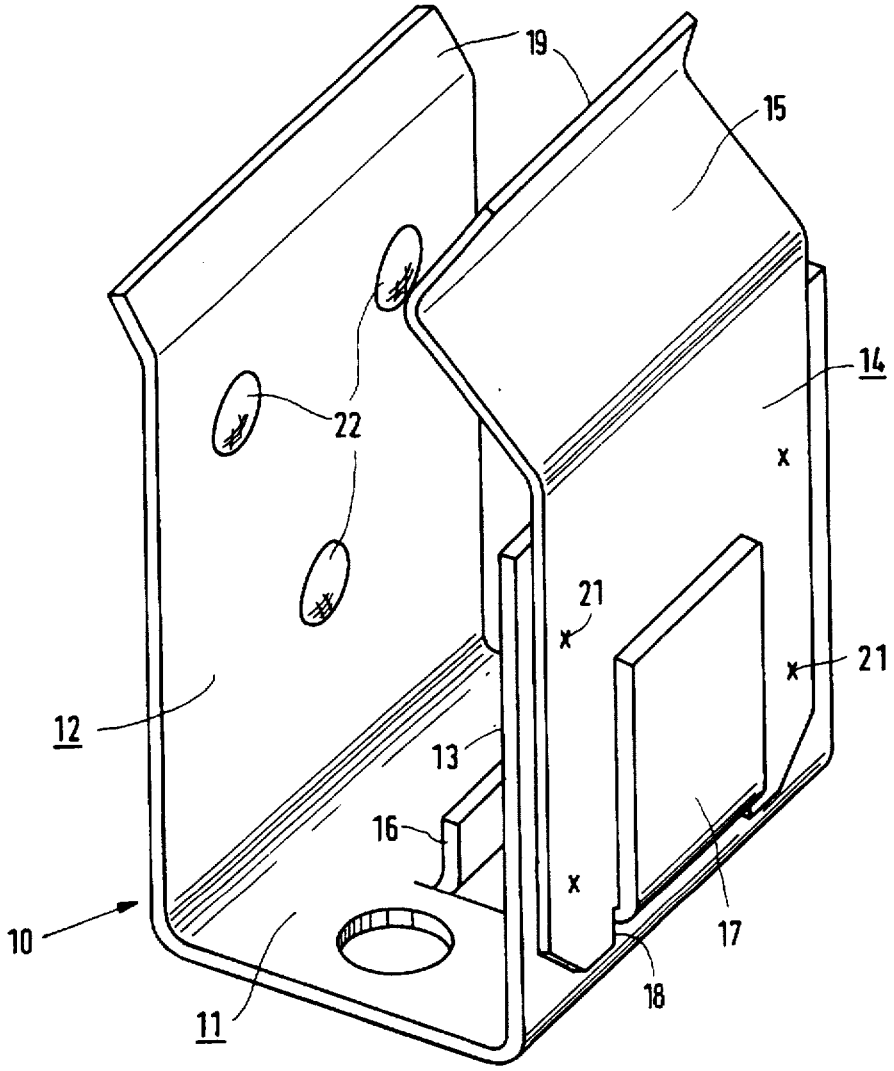

The second wall 13, see FIGS. 2 and 3, has a resilient element 14 with an end portion 15 lying at a distance from the base 11 and directed towards the base 11 and towards the first wall 12 at an acute angle. The base 11 and the first wall 12 are comparatively rigid and are comparatively rigidly interconnected. Each holder 10, see FIG. 1, accommodates a respective flat ceramic cap 31 of a double-capped electric radiation source 30 which comprises a quartz-glass vessel 32 which is closed in a gastight manner, while the resilient element 14 presses with its end portion 15 against a common edge 33 of two surfaces 34, 35 of the cap 31. The reflector 1 is concave in the direction transverse to the pair of holders 10 and plane in the direction of the pair of holders 10.

An elevation 16 is present on the base 11 between the walls 12, 13, see FIGS. 2 and 3. The elevation 13 is a tag which was cut out and bent from the base 11.

The resilient element 14 is a separate component which was fixed with welds 21 in the embodiment drawn.

The second wall 13 has incisions extending transverse to the base 11 and defining a tongue 17 which is bent from the second wall 13, extends substantially parallel thereto, and constitutes a seat for the resilient element 14.

The resilient element 14 has a recess 18 through which the tongue 17 extends. As a result, the element can be accurately positioned.

The first wall 12 and the resilient element 14 have an insertion opening 19 narrowing towards the base 11 for easy entry of the cap of a radiation source.

The first wall 12 has several inwardly depressed bulges 22 in distributed arrangement so as to form a discrete abutment for the ceramic cap 31, see FIG. 1.

We claim:

1. An irradiation device comprising:

a concave reflector (1);

a pair of mutually separated holders (10) for mechanically retaining an elongate electric radiation source (30) at two ends, which holders lie in one another's extended direction and are connected to the reflector, and which holders (10) each have a base (11) and transverse thereto a first (12) and a second wall (13) in mutual opposition, characterized in that the second wall (13) has a resilient element (14) with an end portion (15) which lies at a distance from the base (11) and which is directed to the base (11) and to the first wall (12) at an acute angle, and the base (11) and the first wall (12) are comparatively rigid and are comparatively rigidly interconnected.

2. An irradiation device as claimed in claim 1, characterized in that an elevation (16) is present on the base (11) between the walls (12, 13).

3. An irradiation device as claimed in claim 2, characterized in that the elevation (16) is a tag which was cut out and bent from the base (11).

4. An irradiation device as claimed in claim 2, characterized in that the resilient element (14) is a separate component.

5. An irradiation device as claimed in claim 4, characterized in that the second wall (13) has incisions which extend transverse to the base (11) and which define a tongue (17) which is bent from the second wall (13), extends substantially parallel thereto, and constitutes a seat for the resilient element (14).

6. An irradiation device as claimed in claim 5, characterized in that the resilient element (14) has a recess (18) through which the tongue (17) extends.

7. An irradiation device as claimed in claim 5, characterized in that the reflector (1) is concave in the direction transverse to the pair of holders (10) and plane in the direction of the pair of holders (10).

8. An irradiation device as claimed in claim 5, characterized in that the first wall (12) and the resilient element (14) have an insertion opening (19) which narrows towards the base (11).

9. An irradiation device as claimed in claim 7, characterized in that each holder (10) accommodates a respective flat ceramic cap (31) of a double-capped electric radiation source (30) with a quartz-glass vessel (32) which is closed in a gastight manner, while the resilient element (14) presses with its end portion (15) against a common edge (33) of two surfaces (34, 35) of the cap (31).

10. An irradiation device as claimed in claim 1, characterized in that the resilient element (14) is a separate component.

11. An irradiation device as claimed in claim 1, characterized in that the reflector (1) is concave in the direction transverse to the pair of holders (10) and plane in the direction of the pair of holders (10).

12. An irradiation device as claimed in claim 2, characterized in that the reflector (1) is concave in the direction transverse to the pair of holders (10) and plane in the direction of the pair of holders (10).

13. An irradiation device as claimed in claim 1, characterized in that the first wall (12) and the resilient element (14) have an insertion opening (19) which narrows towards the base (11).

14. An irradiation device as claimed in claim 2, characterized in that the first wall (12) and the resilient element (14) have an insertion opening (19) which narrows towards the base (11).

* * * * *